United States Patent [19]

Ortwein

[11] Patent Number: 4,527,736

[45] Date of Patent: Jul. 9, 1985

[54] ELASTOMERIC RAILWAY-RAIL MOUNT

[75] Inventor: Hermann Ortwein, Cologne, Fed. Rep. of Germany

[73] Assignee: Clouth Gummiwerke Aktiengesellschaft, Cologne, Fed. Rep. of Germany

[21] Appl. No.: 536,174

[22] Filed: Sep. 27, 1983

[30] Foreign Application Priority Data

Oct. 27, 1982 [DE] Fed. Rep. of Germany ..... 3239685

[51] Int. Cl.[3] ..... E01B 9/62; E01B 11/54; E01B 19/00

[52] U.S. Cl. ..... 238/283; 238/153; 238/382

[58] Field of Search ..... 238/151, 152, 153, 154, 238/155, 156, 157, 158, 159, 160, 161, 283, 382

[56] References Cited

U.S. PATENT DOCUMENTS

| | | | |
|---|---|---|---|
| 744,829 | 11/1903 | Weber | 238/155 |
| 996,633 | 7/1911 | Forsyth | 238/156 |
| 1,012,068 | 12/1911 | Ewing | 238/160 |
| 1,240,660 | 9/1917 | Braine | 238/155 |
| 3,662,951 | 5/1972 | Smith et al. | 238/283 X |
| 4,266,719 | 5/1972 | Ortwein et al. | 238/283 |
| 4,275,832 | 6/1981 | Kenyon | 238/283 X |

FOREIGN PATENT DOCUMENTS

| | | | |
|---|---|---|---|
| 1204697 | 11/1965 | Fed. Rep. of Germany | 238/283 |
| 295599 | 3/1954 | Switzerland | 238/151 |

*Primary Examiner*—David A. Scherbel
*Assistant Examiner*—Howard Beltran
*Attorney, Agent, or Firm*—Karl F. Ross; Herbert Dubno

[57] ABSTRACT

A mount for a railroad rail having an inner side turned toward another such rail and an outer side turned away from the other rail has a one-piece base supported on the ground under the one rail and formed with an upwardly open recess having inner and outer base flanks respectively generally under and parallel to the inner and outer sides, the outer base flank being formed as an inwardly overhanging ridge. An insert attached to the rail and received in the recess has respective inner and outer insert edges, the former of which is overhung by the ridge. An elastomeric body lies between the inner flank and inner edge and supports the insert in the base. Due to the overhang of the base edge, it is possible to make the base in one piece at least outward from a location underneath the rail. Thus there is no need to make the base from two parts split along a horizontal plane and requiring tedious assembly in the field.

9 Claims, 5 Drawing Figures

Fig. 4
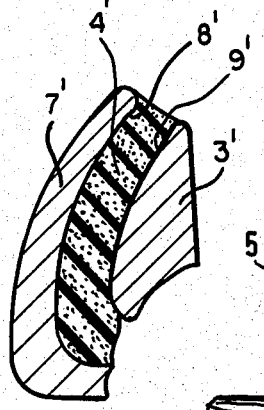
Fig.1
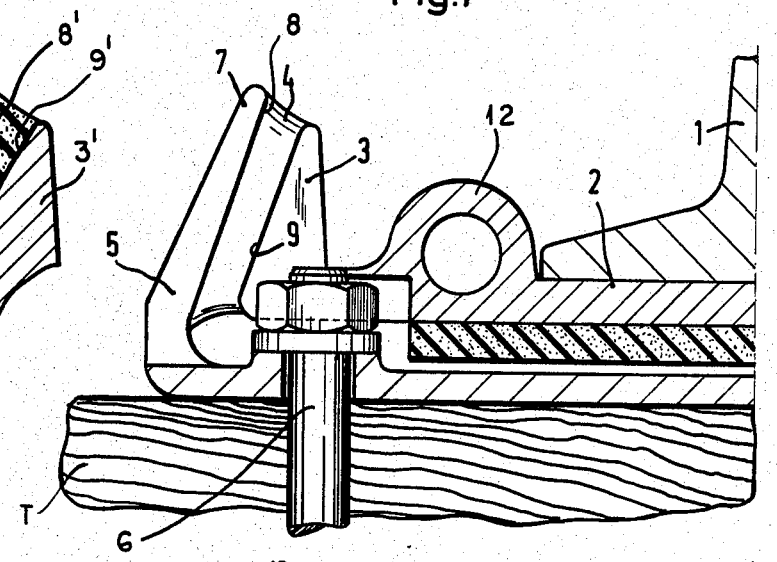
Fig. 2
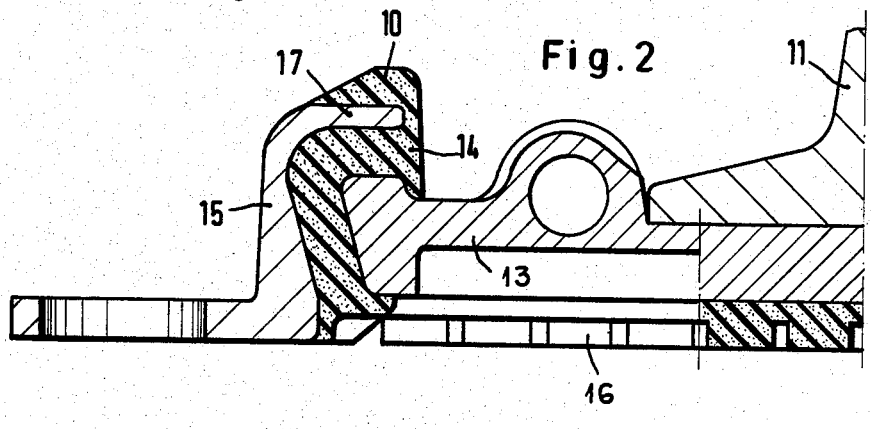
Fig.3
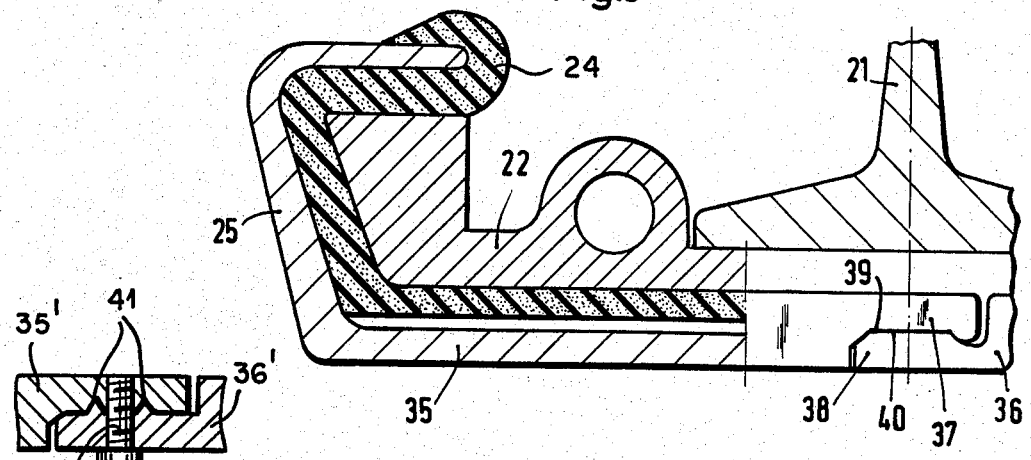
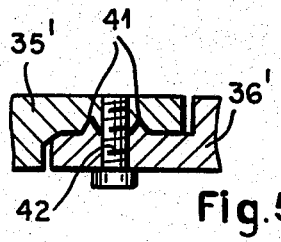
Fig.5

ELASTOMERIC RAILWAY-RAIL MOUNT

CROSS-REFERENCE TO RELATED APPLICATIONS

This application is related to Ser. No. 292,788 and 292,789 both filed Aug. 14, 1981 and commonly assigned herewith.

FIELD OF THE INVENTION

The present invention relates to a railway-rail mount. More particularly this invention concerns such a mount which employs a layer of elastomeric material for electrical and/or vibrational insulation.

BACKGROUND OF THE INVENTION

It is known, as for examples from commonly owned U.S. patent applications Nos. 292,788 and 292,789 filed Aug. 14, 1981 for a railway-rail mount for one of a pair of railroad rails having inner sides turned toward each other and outer sides turned away from each other to have a base supported on the ground under the one rail and formed with an upwardly open recess having inner and outer base side flanks respectively generally under and parallel to the inner and outer sides and end base flanks extending between the side base flanks and transverse to the rail. These side flanks form with the vertical an angle different from that of the end flanks and may even be different from each other. In addition the end flanks can be at different angles to each other to compensate for one-way loading of the mount. An insert, for instance a tie or metal plate, attached to the rail is received in the recess and has respective side and end insert flanks juxtaposed with, generally parallel to, and spaced from the respective base flanks. Respective side and end elastomeric bodies that are inclined to the vertical lie between the base and insert flanks and support the insert in the recess of the base.

Such arrangements have proven to be very effective in use, allowing a train to run smoothly on them and electrically insulating them, as is often necessary. Still they are fairly complex assemblies that are expensive to fabricate, especially in the field.

In order to reduce the possibility of the rail and insert pulling up out of the base, each base normally is split along a horizontal plane into an upper part that overreaches the insert carrying the rail, and a lower part that is fixed to the ground. Bolts secure these parts together, so that the assembly has quite a few parts.

Another disadvantage of the known systems is that, when the rail is being used to conduct electricity, it is fairly easy for a conductive object that falls on the assembly to ground out the rail. For instance a metal bar or wrench can fall across the top of the rail and the top of the outer edge of the base and form a good electrical connection therebetween.

OBJECTS OF THE INVENTION

It is therefore an object of the present invention to provide an improved elastomeric railway-rail mount.

Another object is the provision of such an elastomeric railway-rail mount which overcomes the above-given disadvantages, that is which is as good in use as the prior-art type, but which is of relatively simple and inexpensive construction.

A further object is to provide an improved elastomeric railway-rail mount wherein accidental grounding of the rail is substantially less likely than has hitherto been the case.

SUMMARY OF THE INVENTION

A mount for a railroad rail having an inner side turned toward another such rail and an outer side turned away from the other rail according to the invention has a one-piece base supported on the ground under the one rail and formed with an upwardly open recess having inner and outer base flanks respectively generally under and parallel to the inner and outer sides, the outer base flank being formed as an inwardly overhanging ridge. An insert attached to the rail and received in the recess has respective inner and outer insert edges, the former of which is overhung by the ridge. An elastomeric body lies between the inner flank and inner edge and supports the insert in the base.

Due to the overhang of the base edge, it is possible to make the base in one piece at least outward from a location underneath the rail. Thus there is no need to make the base from two parts split along a horizontal plane and requiring tedious assembly in the field.

The inner and/or outer base flanks according to this invention can be arcuately inwardly concave.

Normally the base and insert are of metal. In addition the elastomeric body can be only in unbonded contact with the insert and base, that is it can merely lie on and be fitted, but not glued or vulcanized, to the insert and base.

The system of this invention normally comprises a railroad tie carrying the rails and having ends constituting respective inserts. This tie is tranverse to the rails.

In accordance with another feature of this invention the elastomeric body has a portion at least partially overlying the base above the insert and extending longitudinally parallel to the rail along the top of the outer edge of the base. This portion is integrally formed with the elastomeric body and serves the valuable function of preventing something that falls transversely on top of the rail and base from grounding out the base. Thus, if for instance a screwdriver or wrench is dropped across the base and rail, it will merely rest on the normally nonconductive insert portion, preventing the rail from being grounded.

It is also possible according to this invention for the base to have a one-piece outer part extending from below the rail to the ridge, and an inner part vertically juxtaposed with the outer part under the rail, although it is not impossible to form the base merely as a pair of transversely spaced clips. When of two-part construction, vertically interengaging formations between the parts are, provided for securing the inner and outer parts together underneath the rail. Such formations typically include an upwardly open recess in one of the parts and a complementary downwardly projecting bump on the other part, or even vertically interengaging sets of teeth on the inner and outer parts. A fastener such as a bolt or rivet can also be engaged vertically through the parts underneath the rail to secure them together. Such a fastener works with the interengaging formations, so it is exposed to minimal stress, unlike the vertical bolts securing together the upper and lower base parts of the prior-art mounts.

According to another feature of this invention the elastomeric body is prestressed, that is permanently compressed between the insert and base. Such prestressing greatly reduces the transmission of vibration between the insert and base.

DESCRIPTION OF THE DRAWING

The above and other features and advantages will become more readily apparent from the following, reference being made to the accompanying drawing in which:

FIG. 1 is is a vertical transverse section through the outer half of a rail mount according to this invention;

FIGS. 2 and 3 are similar sections through further mounts in accordance with the invention; and FIGS. 4 and 5 are sectional views of details of variations on the mount of the present invention.

SPECIFIC DESCRIPTION

As seen in FIG. 1, a railroad-rail 1, here shown to the outside of its vertical symmetry plane, sits on a metallic insert or plate 2 that may be formed by the respective outer end of a transversely extending railroad tie T whose opposite end carries another such rail. An eye 12 on the insert 2 anchors a standard but here unillustrated clip that itself holds the rail 1 in place on the insert 2.

The insert 2 has an outer edge 3 formed with an upright outer base surface 9 that is inclined inward toward the rail 1. A base 5 has an upright outer edge 7 that is similarly flat and inwardly inclined, having an inner surface 8 that is parallel to and spaced outward from the surface 9. This base 5 is secured on the ground or to underlying structure by bolts 6.

An elastomeric body 4 substantially completely fills the space between the base 5 and insert 2. Since the outer edge or ridge 7 slightly overhangs the outer edge 3, there is no need to provide any particular fastening to prevent the insert 2 from pulling up off the base 5.

It is also possible as shown in FIG. 4 for the outer edges 3′ and 7′ to have respectively complementary inwardly concave and outwardly convex surfaces 9′ and 8′ between which the body 4′ is provided. Such structure also effectively resists upward separation of the insert 2 from the plate 5.

FIG. 2 shows a similar arrangement wherein a rail 11 is carried on an insert 13 carried in turn on an insert 14 within a base plate 16. Here, however, the outer edge 15 of the plate 16 is bent horizontally inward at 17 so as to extend inward well beyond the outermost part of the outer edge of the insert 13. In addition the elastomeric body 14 has a portion 10 that overlies the top of this bent-in portion or ridge 17. Thus if a conductive object, such as a tool or other metallic element, falls onto the mounted rail, it will normally rest only on the portion 10 and will not ground out the rail 11 to the grounded base 16, it being understood that the elastomeric body 14 is normally electrically nonconductive.

The arrangement of FIG. 3 is substantially identical to that of FIG. 2 except that the base plate here has an outer part 35 and an inner part 36, the former being formed with an outer edge 25 substantially identical to the edge 15, with an elastomeric body 24 supporting the insert 22 and rail 21 in it. The parts 35 and 36 have complementary inner and outer ends 37 and 38 formed with an interfitting recess 39 and bump 40. This prevents the two parts 35 and 36 from moving transversely, that is from right to left in the drawing, relative to each other.

FIG. 5 shows another such arrangement wherein an inner part 35′ and an outer part 36′ have interfitting teeth 41 and are traversed by a bolt 42. This arrangement also ensures excellent anchoring of the two parts of the base together.

The elastomeric body according to this invention is an independent element for easy assembly of the mount in the field. Thus the entire mount is of relatively simple construction and of substantially fewer parts than the prior-art such systems. Using the elastomeric body, normally made of an insulating synthetic resin, to cover the top of the outer edge of the base not only eliminates a major cause of accident—shorting of the rail to the base—but also protects the top of the base outer edge from the elements and from any sparks or particles shed by a shoe riding on the rail.

What is claimed is:

1. A railroad rail assembly comprising:

a metal base plate having along one side thereof a flank inclined to the vertical and a horizontal portion integral with said flank;

a metal insert plate spaced above said horizontal portion and having along an edge thereof a flank inclined to the vertical and juxtaposed spacedly with said flank of said base plate, said flank of said base plate overhanging said insert plate and having an upper edge lying inwardly of the outline of said insert plate at said edge thereof;

a rail resting on said insert plate and supported thereby in spaced relation from said flanks;

a least one body of elastomeric material received between said insert and said bottom portion and between said flanks with at least part of said body of elastomeric material overhanging said insert plate outwardly of said rail for supporting said insert plate on said base plate; and said flank of said base plate partically enclosing said body of elastomeric material and said edge of said insert plate.

2. The assembly defined in claim 1 wherein said flank of said base plate has an inwardly concave curved surface and said flank of said insert plate has an outwardly convex curved surface, said body of elastomeric material being received between said surfaces.

3. The assembly defined in claim 1 wherein said flanks have juxtaposed planar surfaces inclined upwardly toward the rail and receiving said body of elastomeric material between them.

4. The assembly defined in claim 1 wherein said flanks have mutually parallel juxtaposed surfaces inclined upwardly and away from said rail and receiving said body of elastomeric material between them.

5. The assembly defined in claim 4 wherein said insert plate is formed with a ridge along said edge of said insert plate forming said flank of said insert plate, said ridge having a planar horizontal upper surface, said flank of said base plate being provided with a horizontally extending flange reaching over the top of said ridge, said body of elastomeric material extending between said flange and the top of said ridge and further extending around a free edge of said flange turned toward said rail and onto an upper surface of said flange.

6. The assembly defined in claim 5 wherein said insert plate is provided in two pieces, further comprising vertically interengaging formations between said pieces directly below said rail for securing said pieces together.

7. The assembly defined in claim 6 wherein said formations include an upwardly open recess in one of said pieces and a complementary downwardly projecting bump on the two pieces.

8. The assembly defined in claim 6 wherein said formations include vertically interengaging sets of teeth on said pieces.

9. The assembly defined in claim 6 wherein said formations include overlapping parts of said pieces traversed by a fastener directly below said rail.

* * * * *